US010041226B2

(12) United States Patent
Hart et al.

(10) Patent No.: US 10,041,226 B2
(45) Date of Patent: Aug. 7, 2018

(54) OPERATOR CABIN POST CONFIGURATION IN WORK VEHICLE

(71) Applicant: Deere & Company, Moline, IL (US)

(72) Inventors: Casey J. Hart, Asbury, IA (US); John Grice, Dubuque, IA (US); Nathan J. Horstman, Durango, IA (US)

(73) Assignee: DEERE & COMPANY, Moline, IL (US)

( * ) Notice: Subject to any disclaimer, the term of this patent is extended or adjusted under 35 U.S.C. 154(b) by 345 days.

(21) Appl. No.: 14/836,093

(22) Filed: Aug. 26, 2015

(65) Prior Publication Data

US 2017/0058483 A1 Mar. 2, 2017

(51) Int. Cl.
*E02F 3/76* (2006.01)
*E02F 9/16* (2006.01)

(52) U.S. Cl.
CPC ..... *E02F 3/7645* (2013.01); *E02F 3/764* (2013.01); *E02F 3/765* (2013.01); *E02F 3/7654* (2013.01); *E02F 9/163* (2013.01)

(58) Field of Classification Search
CPC .... B62D 33/0617; E02F 9/163; E02F 9/0858; E02F 3/7636
USPC ..... 296/190.01; 180/89.12
See application file for complete search history.

(56) References Cited

U.S. PATENT DOCUMENTS 185,623 A 12/1876 Burnham
1,999,226 A * 4/1935 Wold ..... E02F 3/7604 172/785
3,061,376 A 10/1962 Barenyi
3,333,888 A 8/1967 Williams et al.
(Continued)

FOREIGN PATENT DOCUMENTS

CN 3187620 5/2001
CN 3352662 2/2004
(Continued)

OTHER PUBLICATIONS

Proteam Auctions, 4th Annual Farm and Equipment Auctions web page for Fiatallis FG65C, http://proteamauction.com/auction/41692_4thAnnualFallAuction.asp?W.
(Continued)

*Primary Examiner* — Robert E Pezzuto
*Assistant Examiner* — Joel F. Mitchell
(74) *Attorney, Agent, or Firm* — Klintworth & Rozenblat IP LLP; Steven Wietrzny

(57) ABSTRACT

A work vehicle includes a main frame extending along a longitudinal axis and a pair of actuators mounted to the main frame. The actuators are configured to set an orientation of a tool mounted below the main frame, which in a home position center the tool on the longitudinal axis. An operator cabin mounted to the main frame has a pair of structural posts extending from a floor to a roof at a front side of the operator cabin. An operator seat mounted in the operator cabin faces forward so as to create a forward field of view to the tool for an operator seated in the operator seat. The front structural posts are spaced apart laterally on each side of the main frame at a distance from a longitudinal axis such that they each overlap along a reference line one of the actuators within a forward-looking field of view.

20 Claims, 7 Drawing Sheets

(56) References Cited

U.S. PATENT DOCUMENTS

| | | | | |
|---|---|---|---|---|
| 3,976,146 | A * | 8/1976 | Desourdy | E02F 3/7636 172/788 |
| 4,049,070 | A | 9/1977 | Soyland | |
| 4,266,625 | A | 5/1981 | Garner et al. | |
| 4,605,259 | A | 8/1986 | Hurlburt | |
| 4,652,043 | A | 3/1987 | Hurlburt | |
| 5,413,188 | A | 5/1995 | Ui | |
| 6,065,799 | A | 5/2000 | Suwabe et al. | |
| 7,243,982 | B2 | 7/2007 | Kelley et al. | |
| D594,036 | S * | 6/2009 | Iwakata et al. | D15/30 |
| 7,607,722 | B2 * | 10/2009 | Frett et al. | B60R 21/131 180/89.12 |
| 8,152,226 | B2 | 4/2012 | Iwakata et al. | |
| 8,333,250 | B2 * | 12/2012 | Knepper et al. | E02F 3/7668 172/781 |
| 8,998,303 | B2 | 4/2015 | Gielda et al. | |
| 9,027,687 | B2 * | 5/2015 | Tokiwa et al. | B60H 1/00378 123/184.21 |
| 2015/0218778 | A1 | 8/2015 | Kimura et al. | |

FOREIGN PATENT DOCUMENTS

| | | | |
|---|---|---|---|
| DE | 2416414 | A1 | 10/1975 |
| DE | 2504700 | A1 | 8/1976 |
| DE | 7413229 | U | 11/1978 |
| DE | 19635751 | C1 | 1/1998 |
| FR | 131866-001 | | 11/1979 |
| GB | 1027863 | | 1/1985 |
| JP | H11158922 | A | 6/1999 |
| JP | 2005146738 | A | 6/2005 |

OTHER PUBLICATIONS

Integrated Publishing, Inc., Chapter 10 Graders and Scrapers web page, http://www.tpub.com/eqopbas/106.htm.

* cited by examiner

OPERATOR CABIN POST CONFIGURATION IN WORK VEHICLE

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to work vehicles, such as motor graders, which have an operator cabin configured to enhance an operator's field of view.

BACKGROUND OF THE DISCLOSURE

An operator cabin in which the vehicle operator is stationed during operation of the vehicles may be mounted on the vehicle chassis in a manner that affords the operator a commanding view of the machine. Yet, often the field of view of an operator may be obstructed by various components of the machine. Structural frame members, actuators, booms, exhaust pipes and the like are examples of necessary components of certain work vehicles that may become an obstruction of the operator's field of view. Some large platform machines are particularly susceptible to this issue, especially where the working tool of the machine is required to be at an inconvenient location from the operator's perspective, such as at a far forward or rearward position or at a low to the ground position.

A motor grader is one example of a work vehicle that has a very long wheel base with the operator cabin perched on the central frame at a mid- to rear-frame mounting location. The operator cabin is also located above and closely behind the rotating turntable or "circle" that supports the moldboard or blade of the grader. The low and close position of the blade with respect to the operator cabin, and its position beneath the central frame, may contribute to a sharp viewing angle that makes it difficult for the operator to see the position of the blade, especially the "toe" and "heel" ends of the blade, at one or more pivot angles on the circle. At times, these may be the critical areas to see in order to ensure proper positioning of the blade. Moreover, the long wheel base of motor graders leaves many components between the operator cabin and the steered wheels at the front of the machine, which may interfere with the operator's ability to see the articulation and lean of the steered wheels. An inability to readily observe the critical working areas in complicated machines, like motor graders, may contribute to imprecise control and operation of the vehicle.

SUMMARY OF THE DISCLOSURE

This disclosure pertains to work vehicles, such as motor graders, which have an operator cabin with structural members positioned to enhance the operator's field of view relative to various components of the machine, such as the wheels and the working tool (e.g., the blade in the case of a motor grader).

In one aspect this disclosure provides a work vehicle having a main frame extending along a central longitudinal axis. First and second actuators are mounted to the main frame and configured to set an orientation of a tool mounted below the main frame. At least in a home position in which the tool is centered on the longitudinal axis, the first and second actuators are oriented along first and second actuator axes that are spaced apart laterally on each side of the main frame at a distance from the longitudinal axis. An operator cabin is mounted to the main frame behind the tool with respect to the longitudinal axis. The operator cabin has first and second front structural posts extending from a floor to a roof at a front side of the operator cabin. An operator seat mounted in the operator cabin faces forward with respect to the longitudinal axis so as to create a forward-looking field of view to the tool for an operator seated in the operator seat. The first and second front structural posts are spaced apart laterally on each side of the main frame at a distance from the longitudinal axis so that, at least when the actuators are in the home position, the first and second front structural posts each overlap along a reference line the first and second actuator axes, respectively, within the field of view.

In another aspect the disclosure provides a motor grader having a main frame extending along a central longitudinal axis. A circle is mounted to the main frame below the main frame, and a blade is mounted to the circle for pivoting with respect to the main frame. First and second actuators are mounted to the main frame and configured to set a height of respective first and second ends of the blade. At least in a home position in which the circle is centered on the longitudinal axis, the first and second actuators are oriented along first and second actuator axes that are spaced apart laterally on each side of the main frame at a distance from the longitudinal axis. An operator cabin is mounted to the main frame behind the blade with respect to the transverse axis. The operator cabin has first and second front structural posts extending from a floor to a roof at a front side of the operator cabin. An operator seat mounted in the operator cabin faces forward with respect to the longitudinal axis so as to create a forward field of view to the blade for an operator seated in the operator seat. The first and second front structural posts are spaced apart laterally on each side of the main frame at a distance from the longitudinal axis so that, at least when the actuators are in the home position, the first and second front structural posts each overlap along a reference line the first and second actuator axes, respectively, within the field of view.

In yet another aspect the disclosure provides a motor grader having a main frame extending along a central longitudinal axis. A circle is mounted to the main frame below the main frame, and a blade is mounted to the circle for pivoting with respect to the main frame. First and second actuators are mounted to the main frame and configured to set a height of respective first and second ends of the blade. At least in a home position in which the circle is centered on the longitudinal axis, the first and second actuators are oriented along first and second actuator axes that are spaced apart laterally on each side of the main frame at a distance from the longitudinal axis. An operator cabin is mounted to the main frame behind the blade with respect to the longitudinal axis. The operator cabin has first and second front structural posts extending from a floor to a roof at a front side of the operator cabin. An operator seat mounted in the operator cabin faces forward with respect to the longitudinal axis so as to create a forward field of view to the blade for an operator seated in the operator seat. The first and second front structural posts are spaced laterally from each side of the main frame at a distance from the longitudinal axis. At least when the actuators are in the home position, the first and second front structural posts each overlap along a reference line the first and second actuator axes, respectively, within the field of view. The position of the first and second front structural posts also provide lower window areas adjacent to lateral sides of the main frame.

The details of one or more embodiments are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1:
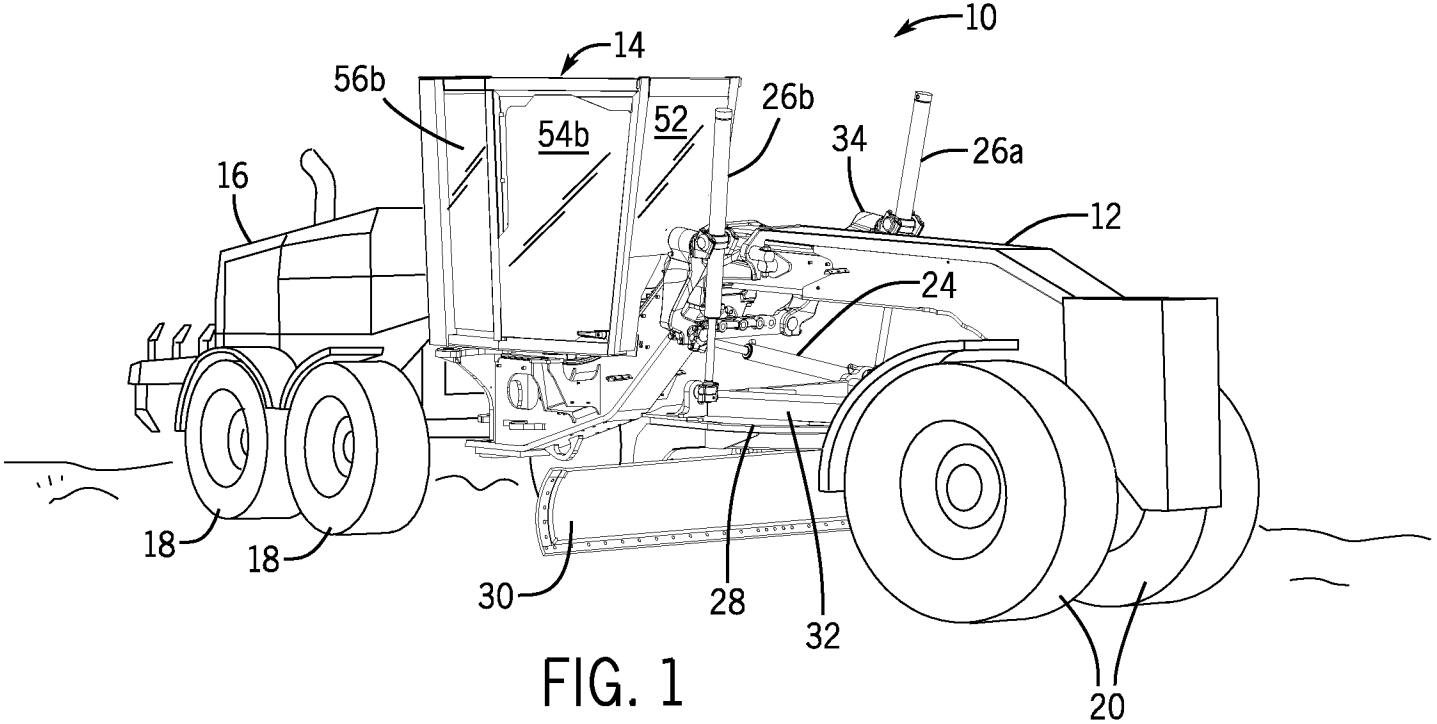
FIG. 1 is a perspective view of a work vehicle in the form of a motor grader having an operator cabin configured according to this disclosure.

The following describes one or more example embodiments of the disclosed work vehicle cabin configuration, as shown in the accompanying figures of the drawings described briefly above. Various modifications to the example embodiments may be contemplated by one of skill in the art.

This disclosure provides a work vehicle having an operator cabin with structural members positioned to improve the operator's field of view relative to various components of the work vehicle. For example, the operator cabin of this disclosure may be part of a motor grader in which the operator cabin may aid in providing a sight field for an operator inside the cabin to various machine components, such as the steered wheels at the front end of the motor grader and the circle and blade (or moldboard) assembly, especially the heel and toe of the blade, typically positioned in a close proximity area forward of the operator cabin.

Structural members of the operator cabin may be configured and located to reduce obstructions to the operator's view in at least two ways. First, the front structural members, often referred to as "A-posts", are positioned inward, that is toward the longitudinal centerline of the machine, compared to some conventional operator cabins, and in any event, inward of intermediate (often called "B-posts") and rear ("C-posts") structural members, forming the respective sides and rear of the operator cabin frame. Moving the front structural members inward helps position them out of the operator's sight lines to the toe and heel ends of the blade, which can be critical for the operator to see in order to gauge blade depth and tilt angle as well as when defining edge surfaces in the ground is important. The front structural members are inwardly positioned, however, they remain spaced from the main frame that runs along the longitudinal centerline of the machine. This spacing allows for viewing forward along the main frame, including to see the steered wheels, which may need to be seen to provide the operator visual feedback of the steering angle and wheel lean. Further, since the front structural members may extend from the floor to the roof of the cabin, spacing of the front structural members from the main frame may provide open viewing areas near the cabin floor, which helps viewing the ground or low to ground components, such as the wheels, and the close-by circle and blade assembly.

Second, the front structural members of the operator cabin are configured so that from the operator's perspective they overlap certain components of the machine, and thereby reduce the number of obstructions in the operator's field of view. The view obstructing components may be any of various machine components within the operator's field of view depending the particular construction or type of work vehicle, for example, other structural members, mounting hardware, booms, exhaust pipes and so on. In the context of a motor grader, the front structural members may be configured to overlap the lift actuator cylinders, which are the large vertical or near-vertical cylinders on each side of the main frame above the circle. The front structural members overlap by aligning with the long axes of the actuators along reference lines extending from a viewpoint of an operator seated in the operator cabin. Again, by overlapping in this manner the number of objects that interfere with an operator's view of the machine or surrounding environment is effectively reduced, since, for example, what would have been four separate obstructions in the case of the two front structural members and the two actuators, would now appear to the operator only as two obstructions by virtue of the actuators being aligned with, and possibly hidden behind, the front structural members.

As can be understood, alignment of the cabin structural members with the components of the machine holds provided the cabin and the machine components remain in fixed relative positions. Relative repositioning of the structural members and the machine components during operation is likely to create situations where the alignment no longer holds. Nevertheless, the operator cabin configuration may still provide field of view enhancements for the operator when only slight changes in relative position occur. For purposes of this disclosure, the configuration of the operator cabin, and particular the positioning of the front structural members, will be referred to with respect to machine components, particularly movable components, when in a home position. The term "home position" should be understood to mean that the component of interest is centered on the longitudinal axis or centerline of the machine. In the context of the motor grader described herein, the home position refers to an orientation of the circle being centered on the longitudinal centerline of the motor grader. Such a centered orientation of the circle may include various angular and side-shifted positions of the blade relative to the main frame. The home position may thus be a common, often used orientation of the machine, such that the operator cabin configuration may provide operator field of view enhancements during a meaningful period of the machine's use, even if not during all possible working orientations.

With reference now to the drawings, example operator cabin configurations will be described in the context of a work vehicle in the form of a motor grader. While a motor grader is illustrated as an exemplary work vehicle herein, one skilled in the art will recognize that the configuration of the operator cabin disclosed herein may be readily adapted for use on other types work vehicles. As such, the present disclosure should not be limited to applications associated with a motor grader.

As shown in FIGS. 1-5, a motor grader 10 may include a main frame 12 supporting an operator cabin 14 and a power plant 16, such as diesel engine, operably coupled to power a drive train (not shown). The main frame 12 is supported by pairs of tandem drive wheels 18 at the rear of the machine and a pair of steered wheels 20 at the front of the machine that are steered by a steering device within the operator cabin 14, such as steering wheel 22. The power plant 16 may power a hydraulic pump (not shown), which pressurizes hydraulic fluid in a hydraulic circuit including various hydraulic valves and actuators, including a circle-shift actuator 24, lift actuators 26*a* and 26*b*, a blade-shift actuator (not shown) and a circle-rotate drive (not shown).

A circle 28 and blade 30 assembly is mounted to the main frame 12 in front of the operator cabin 14 by a drawbar 32 from the front of the main frame 12 and a lifter bracket 34 from the top of the main frame 12. In certain embodiments, the lifter bracket 34 may be movable with respect to the main frame 12, such as to pivot around the main frame 12. The cylinders of the lift actuators 26*a*, 26*b* may be mounted to the lifter bracket 34, and the pistons of the lift actuators 26*a*, 26*b* may be connected to the circle 28 to raise, lower and tilt the circle 28, and thereby the blade 30. The circle 28, via the circle drive and various actuators, allows the blade 30 to be rotated relative to a vertical axis through a range of angular orientations as well as shifted sideways or laterally in relation to the main frame 12 and/or the circle 28. The figures illustrate the circle 28 oriented in a home position in which the circle 28 is centered under the main frame 12, specifically, centered on a longitudinal axis 36, which in this case is a centerline of the main frame 12. In this home position, the lift actuators 26*a*, 26*b* are oriented along lift actuator axes 38*a*, 38*b* that may be spaced apart laterally on each side of the main frame 12 an equal distance from the longitudinal axis 36. In the home position illustrated, the lift actuator axes 38*a*, 38*b* are canted slightly forward and outward with respect to the longitudinal axis 36 from bottom to top.

The operator cabin 14 provides an enclosure for an operator seat 40 and an operator console for mounting various control devices, communication equipment and other instruments used in the operation of the motor grader 10. The operator cabin 14 has a structural frame including left and right front structural members, or A-posts 42*a*, 42*b*, left and right intermediate structural members, or B-posts 44*a*, 44*b*, and left and right rear structural members, or C-posts 46*a*, 46*b*, all of which may extend some or all of the way from a floor 48 to a roof 50. One or more window panels, such as a front window panel 52, may be supported between the A-posts 42*a*, 42*b* and extend from the floor 48 to the roof 50. The sides of the cabin 14 may include side doors 54*a*, 54*b* and one or more side window panels, such as side window panels 56*a*, 56*b*, that may extend from the floor 48 to the roof 50. Each side door 54*a*, 54*b* may be supported between its respective A-post 42*a*, 42*b* and B-post 44*a*, 44*b*, with the side doors 54*a*, 54*b* secured to the B-post 44*a*, 44*b* with hinges 58 to provide access into the operator cabin 14. Each side window panel 56*a*, 56*b* may be supported between its respective B-post 44*a*, 44*b* and C-post 46*a*, 46*b*. One or more rear window panels, such as rear window panel 60, may be supported between the C-posts 46*a*, 46*b* and extend from the floor 48 and the roof 50. The front window panel 52, side doors 54*a*, 54*b*, side window panels 56*a*, 56*b* and rear window panel 60, or a portion thereof, may be transparent to enable an operator "0" seated in the operator seat 40 within the operator cabin 14 to see the components of the motor grader 10 and other objects outside of the operator cabin 14.

Figures 2, 2A:
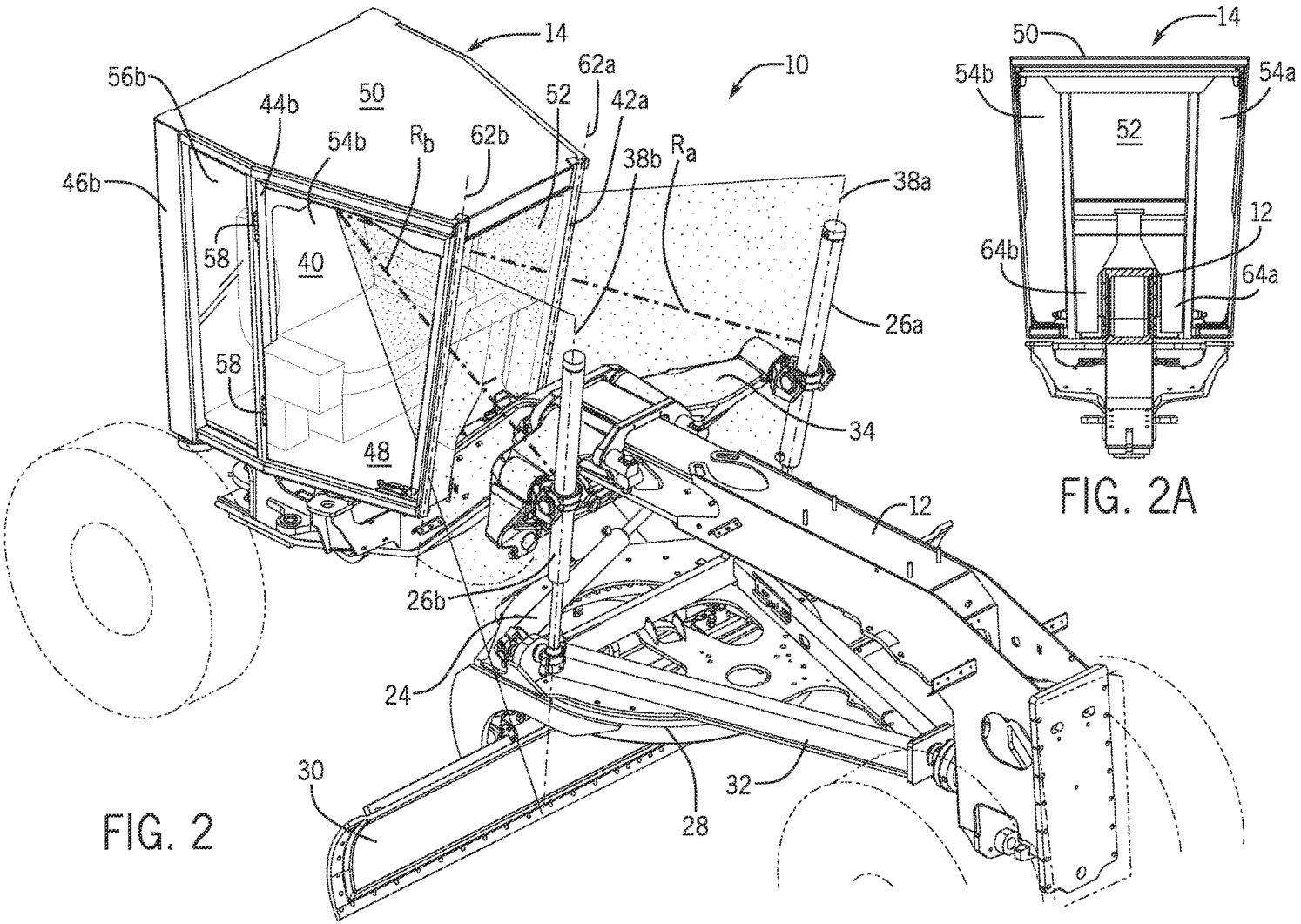
FIG. 2 is a perspective view of the operator cabin with main frame and working tool components of the motor grader of FIG. 1 shown.
FIG. 2A is a detail view showing a lower front window area taken from area 2A-2A of FIG. 2.
Figure 5:
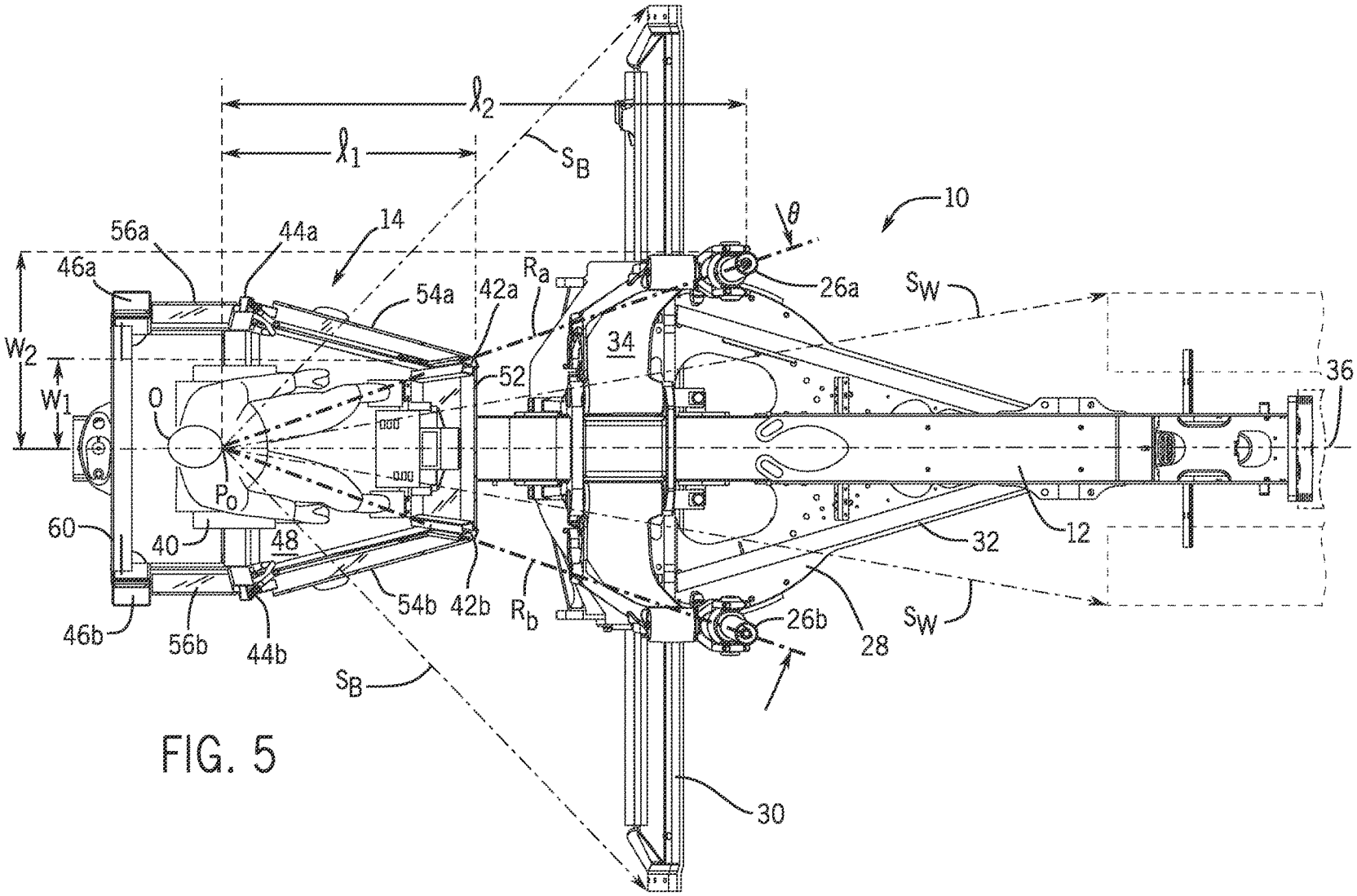
FIG. 5 is a top view thereof.

Referring to the top view shown in FIG. 5, the operator cabin 14 may be configured so that the C-posts 46*a*, 46*b* and the rear window panel 60 are aligned across the rear of the operator cabin 14 generally perpendicular to the longitudinal axis 36 of the main frame 12. The B-posts 44*a*, 44*b* and the side window panels 56*a*, 56*b* are forward of the associated C-post 46*a*, 46*b*, and may be aligned with the associated C-post 46*a*, 46*b* generally parallel to the longitudinal axis 36 so as to be spaced from the longitudinal axis 36 the same, or substantially the same, distance. The A-posts 42*a*, 42*b* are located forward of the B-posts 44*a*, 44*b* and inward, closer to the longitudinal axis 36. The A-posts 42*a*, 42*b*, however, are spaced from the longitudinal axis by a perpendicular distance "w" so that an open window area 64 is available on each side of the longitudinal axis 36 for viewing by the operator O between the main frame 12 and the A-posts 42*a*, 42*b* at a lower portion of the operator cabin 14, as shown in FIG. 2A. These lower window areas 64 may be useful for the operator O to view the circle 28 and blade 30 components under the main frame 12, which, by virtue of being located in close proximity to the operator cabin 14, require a sharp downward viewing angle from the operator's seated position.

In the illustrated example, the operator cabin 14, and its A-, B- and C-posts and various window panels, are centered on the longitudinal axis 36, which in this case may be considered a centerline of the main frame 12 or the motor grader 10 generally. As such, the various posts on the left side of the machine are spaced apart the same distance from the longitudinal axis 36 as the corresponding posts on the right side of the machine. However, it should be noted that the operator cabin 14, and the posts, panels and doors could be asymmetric with the longitudinal axis 36, or the longitudinal axis 36 could be asymmetric with the main frame 12 or motor grader 10, such that the posts, panels and doors may be spaced differently from the longitudinal axis 36 or other centerline of the motor grader 10.

Figure 3:
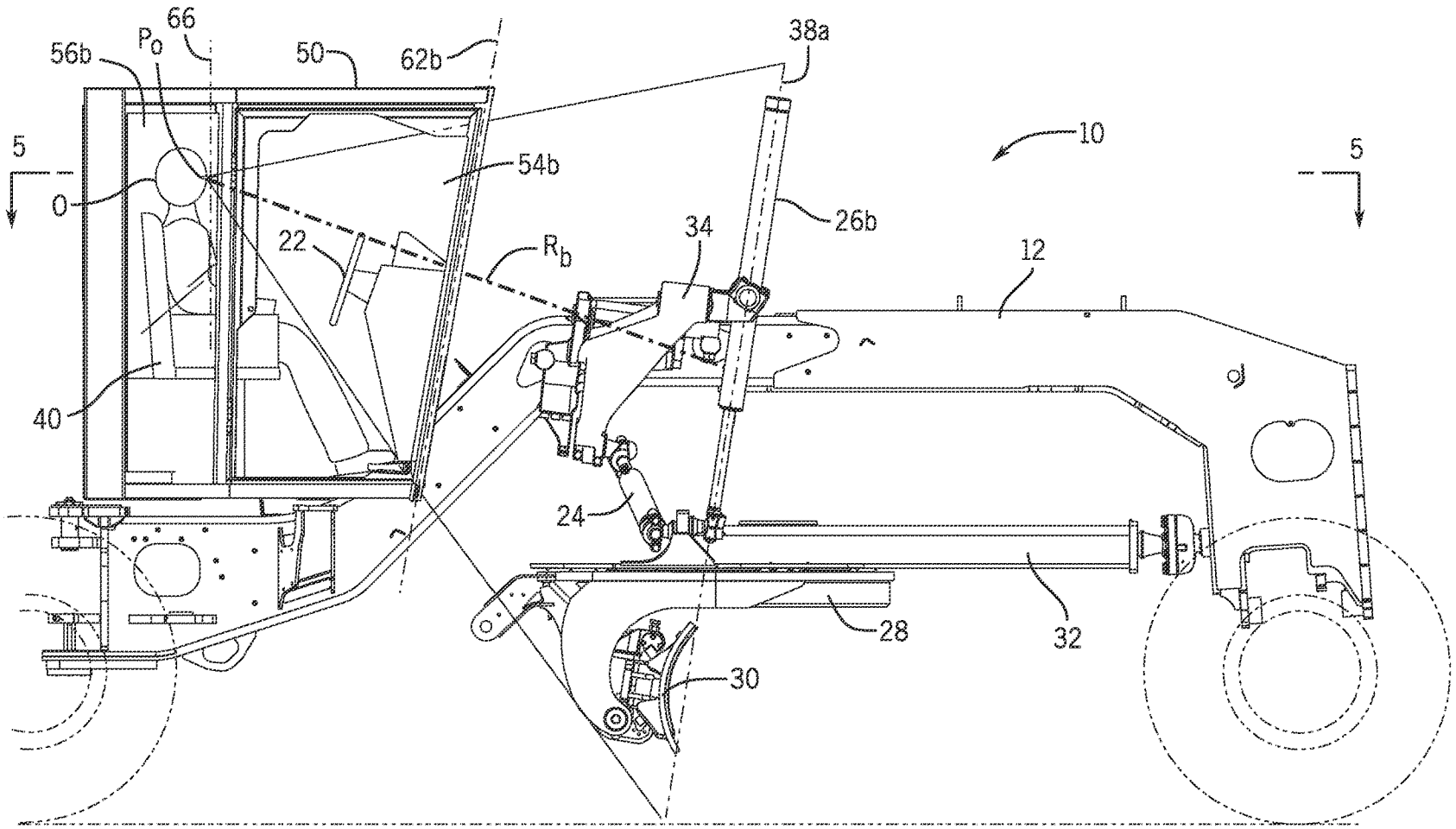
FIG. 3 is a side view of the example motor grader as shown in FIG. 2.
Figure 4:
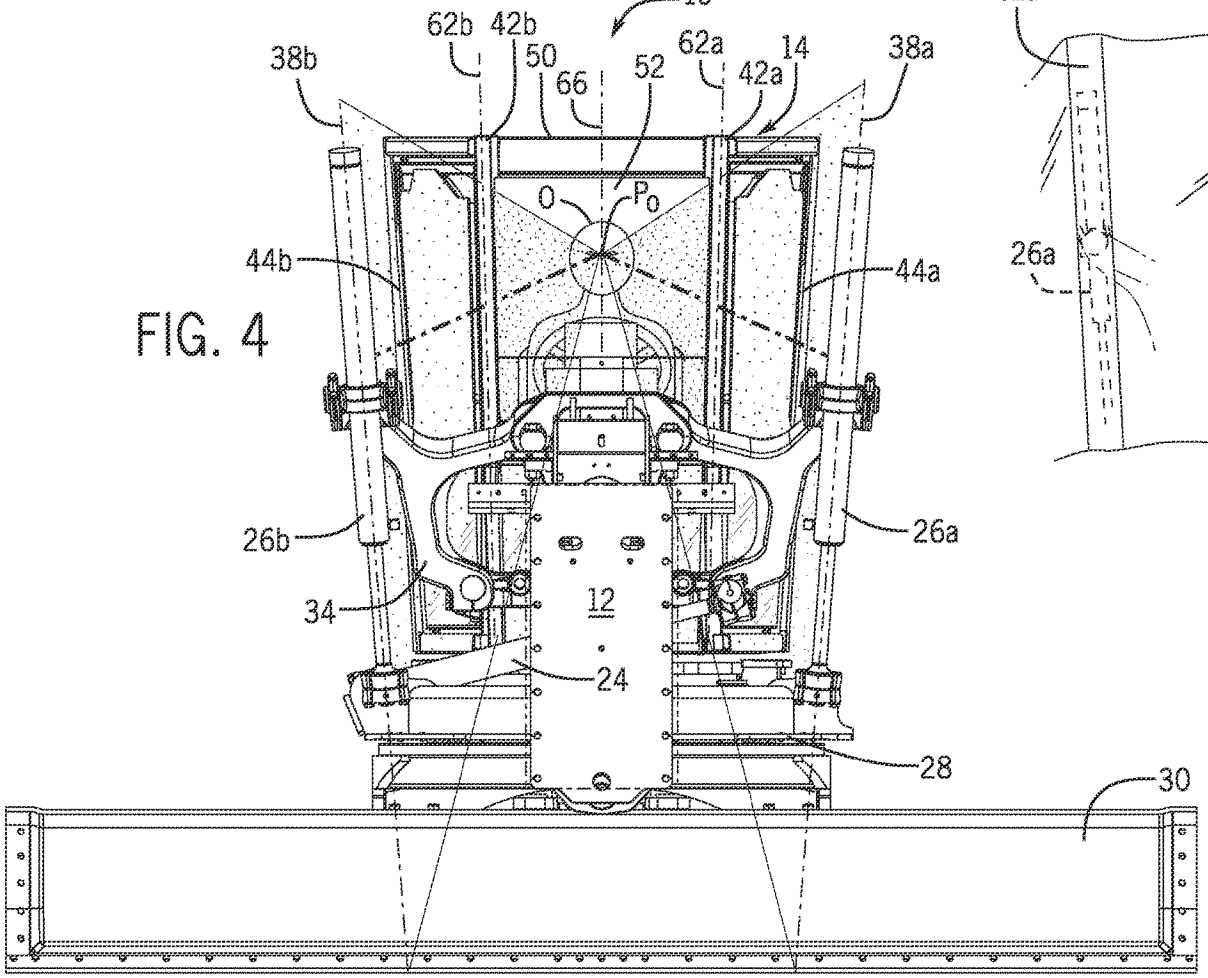
FIG. 4 is a front view thereof.

The various posts, panels and doors of the operator cabin 14 may be configured to extend in an upright or vertical direction generally perpendicular to a level plane containing the longitudinal axis 36. However, the posts, panels and doors of the operator cabin 14 may also be angled with respect to such a level plane. For example, as can be seen in FIGS. 3-5, the operator cabin 14 in the illustrated example may have a larger roof 50 than floor 48, such that the various posts, panels and doors angle outwardly on the left and right sides of the longitudinal axis 36 from the floor 48 to the roof 50. Further, while the C-posts 46*a*, 46*b* and the rear window panel 60 may be aligned laterally (i.e., from the seated operator's left to right) perpendicular to the longitudinal axis 36, the A-posts 42, 42*b* and the front window panel 52 may be angled forwardly from the floor 48 to the roof 50. The A-posts 42*a*, 42*b* may thus extend along A-post axes 62*a*, 62*b* that angle both forwardly and outwardly with respect to the longitudinal axis 36 from the floor 48 to the roof 50. Since the side doors 54*a*, 54*b* extend between the associated A-posts 42*a* 42*b* and B-posts 44*a*, 44*b*, in addition to angling outwardly from the longitudinal axis 36, they are oriented obliquely (i.e., neither parallel nor perpendicular) with respect to the longitudinal axis 36 to be closer to the longitudinal axis 36 at their A-posts edges than at their B-post edges.

Figure 6:
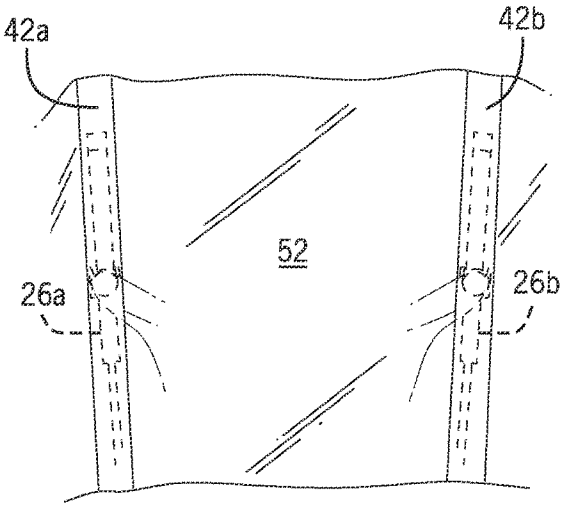
FIG. 6 is a schematic view showing the overlap of front structural members of the operator cabin with actuator components from a partial forward field of view of an operator seated inside the operator cabin shown of FIG. 2.

Generally, the configuration of the operator cabin 14 gives the operator O the ability to view the motor grader components and the surrounding areas in all directions—front, rear and sides. As the operator cabin 14 in the example motor grader 10 is positioned near the rear of the main frame 12 behind the circle 28 and blade 30 assembly and the steered wheels 20, the operator O typically will have a generally forward field of view when seated in the operator seat 40 during operation of the motor grader 12. The configuration of the operator cabin 14 provides a forward field of view that includes a front field "F" between the A-posts 42*a*, 42*b*, including the viewing area between the main frame 12 and the A-posts at the lower portion of the front of the operator cabin 14, in which the main frame 12 and the steered wheels 20 may be viewed by the operator O through the front window panel 52. The forward field of view afforded the operator O also includes lateral fields "$L_a$", "$L_b$" to the left and right sides of the front field F in which components of the motor grader 10 at the left and right sides, such as the heel and toe of the blade 30, may be viewed by the operator O through the side doors 54*a*, 54*b* and/or side window panels 56*a*, 56*b*. As depicted schematically in FIG. 6, the A-posts 42*a*, 42*b* are positioned so that, when the motor grader 10 is in the home position, they overlap the lift actuators 26*a*, 26*b* from the operator's forward field of view, as described in more detail below. In this way, the front field F is separated from the left $L_a$ and right $L_b$ lateral fields by a single obstruction line, or narrow lateral zone, at each left and right side of the longitudinal axis 36 corresponding to the size and location of the overlapping A-posts 42*a*, 42*b* and lift actuators 26*a*, 26*b*. Thus, from certain perspectives of the operator O, the lateral dimension of each obstruction may be limited to that caused by either the A-posts 42*a*, 42*b* or the lift actuators 26*a*, 26*b*, depending on their relative sizes.

More specifically now, a body axis 66 may be defined as an axis extending generally vertically from a point centrally located on the operator seat 40 (e.g., a centered hip point or H-point), for example, which may intersect a mid-point between the eyes of the operator O seated in the operator seat 40. A field of view origination point "$P_o$" for the operator O may thus be established along the body axis 66. Since the operator seat 40 in the illustrated example is centered on the longitudinal axis 36, and given the general body symmetric of the operator O, the lateral location of the origination point $P_o$ will generally fall along the body axis 66. The vertical location of the origination point $P_o$ may be at varying heights along the body axis 66 depending on the seated height of the operator O.

From the field of view origination point $P_o$, the A-posts 42*a*, 42*b* and the lift actuators 26*a*, 26*b* fall long obstruction reference lines "$R_a$", "$R_b$" that extend from the field of view origination point $P_o$ and intersect the A-post axes 62*a*, 62*b* and the lift actuator axes 38*a*, 38*b*. Obstruction reference lines $R_a$, $R_b$ are used herein to represent an average of a continuum or zone of lines extending from the field of view origination point $P_o$ along the length of the A-post axes 62*a*, 62*b*, as represented in FIG. 2. Moreover, the obstruction reference lines $R_a$, $R_b$ also represent a lateral zone of obstruction along the A-post axes 62*a*, 62*b* having a narrow lateral dimension perpendicular to the longitudinal axis 36 corresponding to the lateral dimension of the A-posts 42*a*, 42*b* and/or the lift actuators 26*a*, 26*b* themselves. As noted above, the A-post axes 62*a*, 62*b* may be angled from vertical in forward and outward orientation with respect to the longitudinal axis 36. In the home position, the lift actuator axes 38*a*, 38*b* may follow a similar off-vertical orientation angling forward and outward from the longitudinal axis 36 so as to be substantially parallel in side view.

The operator's front field F may be defined in top view as sweeping the angle θ in a horizontal plane extending through the A-post axes 62*a*, 62*b* and the lift actuator axes 38*a*, 38*b*. From this perspective then, the geometric relationship of the A-posts 42*a*, 42*b* with respect to the lift actuators 26*a*, 26*b* may follow the trigonometric function:

$$\tan\frac{\theta}{2} = \frac{w_1}{l_1} = \frac{w_2}{l_2}$$

wherein:

- θ is the angle of the front field of the operator's field of view;
- $w_1$ is the lateral distance from the origination point $P_o$ to the A-post axis;
- $l_1$ is the longitudinal distance from the origination point $P_o$ to the A-post axis;
- $w_2$ is the lateral distance from the origination point $P_o$ to the lift actuator axis; and
- $l_2$ is the longitudinal distance from the origination point $P_o$ to the lift actuator axis.

Thus, the spacing for the A-posts 42*a*, 42*b* and the lift actuators 26*a*, 26*b* within a given horizontal plane may generally be governed by the following relationship:

$$w_1 = l_1 \cdot \frac{w_2}{l_2}$$

The configuration of the operator cabin 14 effectively reduces the obstruction to the operator's forward field of view due to the structural members and the lift actuators to a single, generally linear obstruction on each side of the longitudinal axis 36. Put another way, in the illustrated example, the number of related obstructions in the operator's forward field of view is reduced from four distinct obstructions to two, or by a 2:1 ratio. This arrangement thus affords the operator O with a straight line of sight from the field of view origination point $P_o$ to various points of interest, including sight lines $S_W$ to the steered wheels 20 and sight lines $S_B$ to the blade 30, such as to the bottom edge and the toe and heel ends of the blade 30.

Figures 7, 7A:
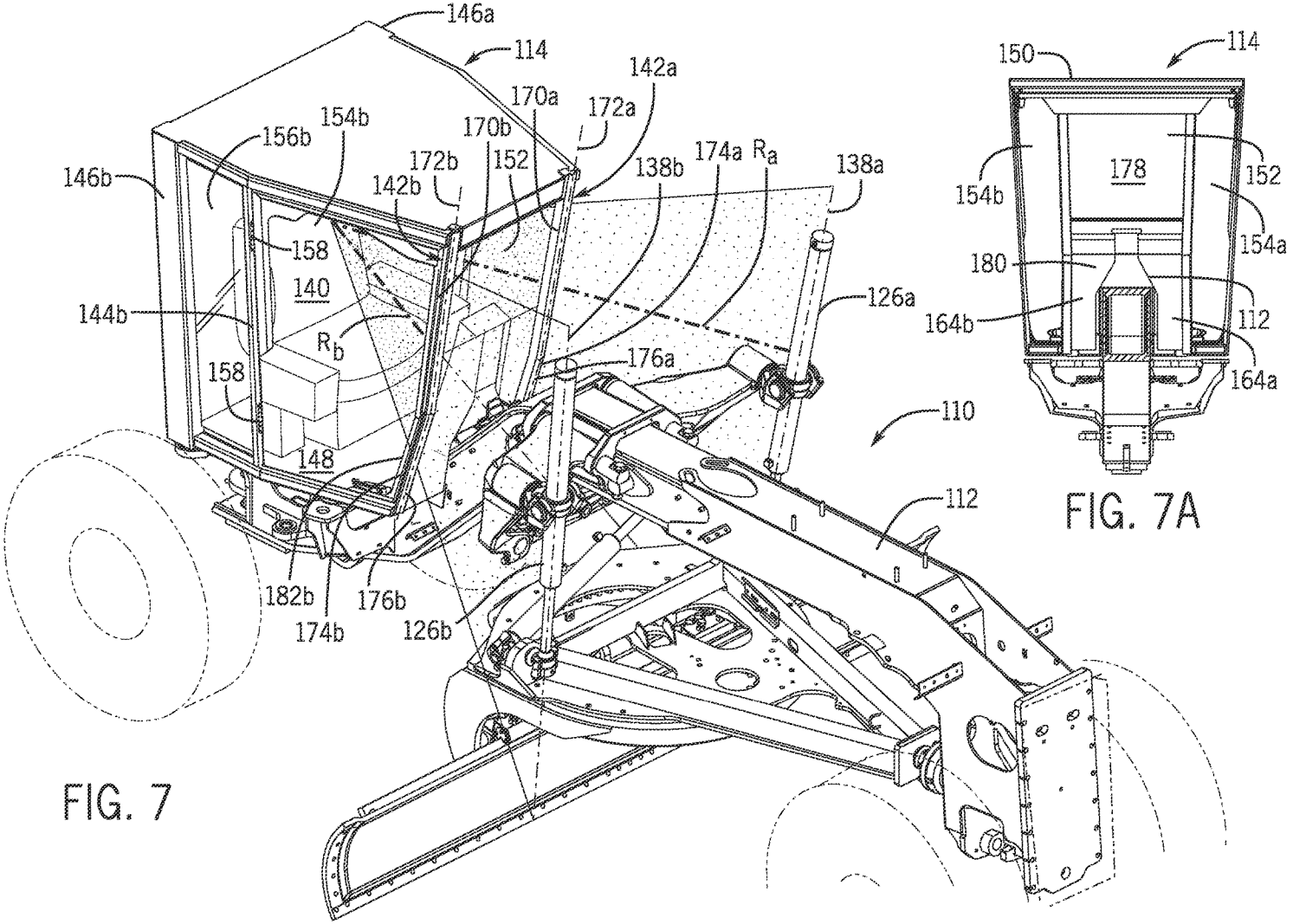
FIG. 7 is a perspective view similar to FIG. 2 showing another example motor grader having an operator cabin according to this disclosure.
FIG. 7A is a detail view similar to FIG. 2A of a lower front window area taken from area 7A-7A of FIG. 7.
Figure 8:
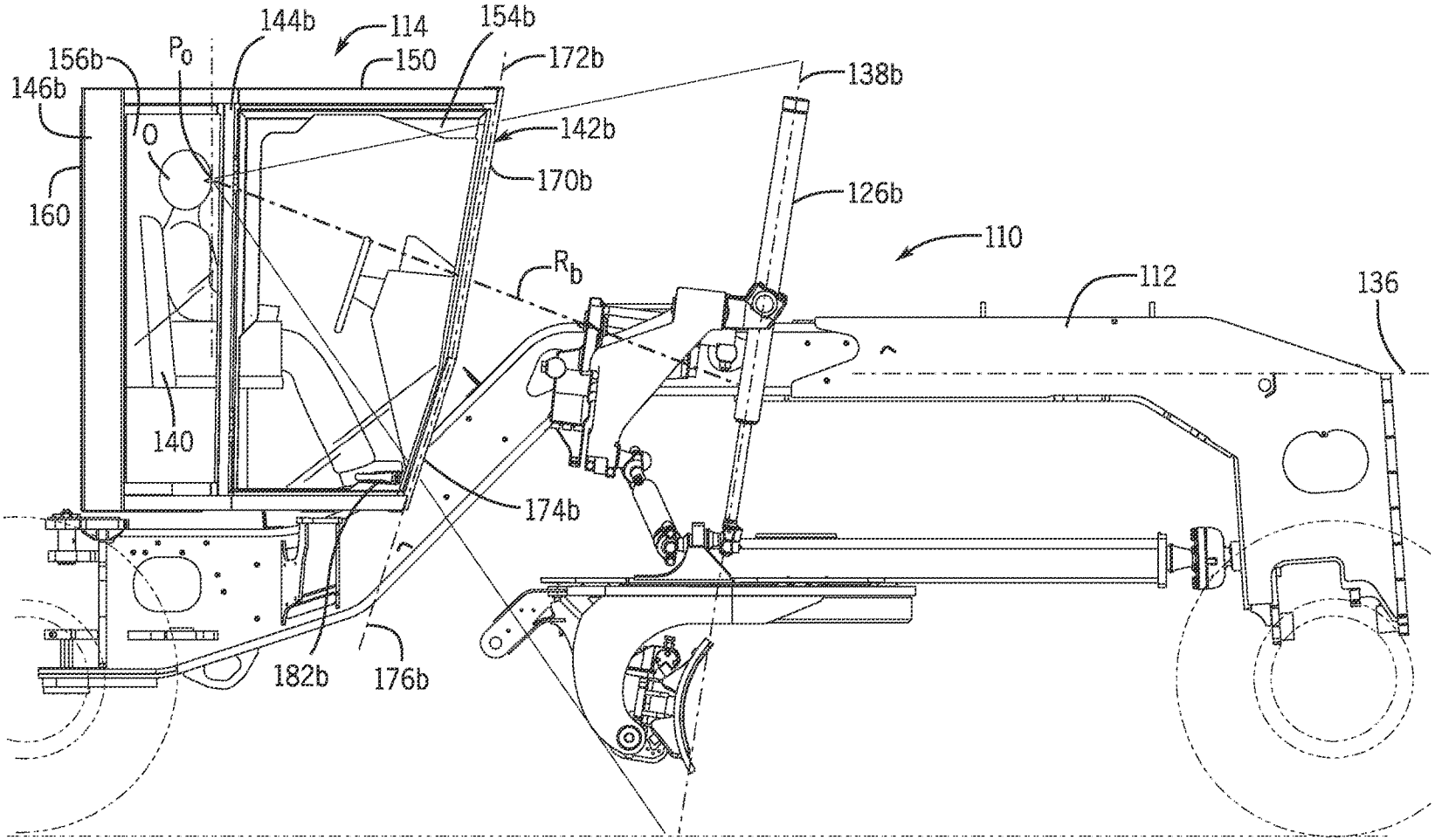
FIG. 8 is a side view of the example motor grader as shown in FIG. 7.

While the A-posts 42*a*, 42*b* shown in FIGS. 1-5 are straight structural members, one skilled in the art will recognize that these structural members need not be linear, but rather may be angled or curved. With reference now to FIGS. 7 and 8, another example of the operator cabin is illustrated that may be incorporated into a work vehicle, such as motor grader. In this example embodiment, with the exception of the operator cabin, the components of the motor grader 110 are the same as the motor grader 10 described above, including a main frame 112 aligned along a longitudinal axis 136 and lift actuators 126*a*, 126*b* aligned along lift actuator axes 138*a*, 138*b*. Like the previously described example, this operator cabin 114 has a similar narrowed front end providing similar enhancements to the operator's field of view as described above. However, with angled front structural members, as will be described, the front viewable area at the lower portion of the operator cabin is expanded due to the compound angle formed as the outwardly angled front structural members are angled rearward at their lower ends.

In particular, the operator cabin 114 has left and right front structural members, or A-posts 142*a*, 142*b*, left (not shown) and right intermediate structural members, or B-posts 144*b*, and left and right rear structural members, or C-posts 146*a*, 146*b*, all of which may extend some or all of the way from a floor 148 to a roof 150. One or more window panels, such as front window panel 152, may be supported between the A-posts 142*a*, 142*b* and extend from the floor 148 to the roof 150. The sides of the cabin 114 may include side doors 154*a*, 154*b* and one or more side window panels, such as side window panels 156*b* (one shown) that may extend from the floor 148 to the roof 150. Each side door 154*a*, 154*b* may be supported between its respective A-post 142*a*, 142*b* and B-post 144*a*, 144*b*, with the side doors 154*a*, 154*b* secured to the B-posts 144*a*, 144*b* with hinges 158 to provide access into the operator cabin 114. Each side window panel 156*a*, 156*b* may be supported between its respective B-post 144*a*, 144*b* and C-post 146*a*, 146*b*. One or more rear window panels, such as rear window panel 160, may be supported between the C-posts 146*a*, 146*b* and extend from the floor 148 and the roof 150. The front window panel 152, side doors 154*a*, 154*b*, side window panels 156*a*, 156*b* and rear window panel 160, or a portion thereof, may be transparent to enable an operator O seated in an operator seat 140 within the operator cabin 114 to see the components of the motor grader 110 and other objects outside of the operator cabin 114.

Here, the A-posts 142*a*, 142*b* have upper segments 170*a*, 170*b*, which each follow an upper A-post axis 172*a*, 172*b*, and a lower segment 174*a*, 174*b*, which each follow a lower A-post axis 176*a*, 176*b* that is at an angle with respect to the associated upper A-post axis 172*a*, 172*b*. While not shown, it should be understood that the upper 172*a*, 172*b* and lower 176*a*, 176*b* A-post axes are each linearly aligned in the forward field of view of the operator O. The A-posts 142*a*, 142*b* are arranged such that, at least when in the home position, the upper A-post segments 170*a*, 170*b* and the lower A-post segments 174*a*, 174*b* are in alignment with the lift actuator axes 138*a*, 138*b* along obstruction reference lines "$R_a$", "$R_b$" so that the A-posts 142*a*, 142*b* effectively overlap with lift actuators 126*a*, 126*b* within the forward field of view of the operator O, such as when viewed from the point of origin $P_o$. As shown in FIG. 8, the upper A-post axes 172*a*, 172*b* are angled forward and outward in a similar manner as the A-post axes 62*a*, 62*b* in the previously described example, and thus may be substantially parallel to the lift actuator axes 138*a*, 138*b*. A similar relationship between the position of the A-posts 142*a*, 142*b* and the lift actuators 126*a*, 126*b* as described above applies to this example embodiment. Similar sight lines to the steered wheels and the critical areas of the blade are afforded to the operator O, as described above.

The front window panel 152, which may be a single continuous panel or multiple separate panels, includes an upper panel portion 178 supported between the upper segments 170*a*, 170*b* and defining an upper window. The front window panel 152 also includes a lower panel portion 180 supported between the lower segments 174*a*, 174*b* and the main frame 112, and defining a front lower window area 164*a*, 164*b* on each side of the longitudinal axis 136, as shown in FIG. 7A. These lower window areas 164*a*, 164*b* angle rearward toward angled lower edges 182*a*, 182*b* of the side doors 154*a*, 154*b*. Since the lower edges 182*b* (one shown) angle rearward, and the side doors 154*a*, 154*b* angle outward in the rearward direction, the area of each of the lower window areas 164*a*, 164*b* is larger than that of the lower window areas 64*a*, 64*b* in the previously described example in which the A-posts are straight members. This may thus further enhance operator viewing of the ground and low to ground machine components, such as critical areas of the circle and blade assembly.

Various advantages other than improved operator field of view may also be achieved by the disclosed configuration of the operator cabin. For example, the configuration and relative orientation of the structural members of the operator cabin allow manually operated hydraulic valves to be mounted under the cabin floor. In this way, control lever linkages would not require bell cranks to actuate the valves, which gives the operator greater control precision when manipulating the various operating components of the machine.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that any use of the terms "comprises" and/or "comprising" in this specification specifies the presence of stated features, integers, steps, operations, elements, and/or components, but do not preclude the presence or addition of one or more other features, integers, steps, operations, elements, components, and/or groups thereof.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various implementations other than those explicitly described are within the scope of the claims.

What is claimed is:

1. A work vehicle, comprising:

a main frame extending along a longitudinal axis;

first and second actuators mounted to the main frame and configured to set an orientation of a tool mounted below the main frame, wherein at least in a home position in which the tool is centered on the longitudinal axis, the first and second actuators are oriented along first and second actuator axes that are spaced apart laterally on each side of the main frame from the longitudinal axis;

an operator cabin mounted to the main frame behind the tool with respect to the longitudinal axis, the operator cabin having first and second front structural posts extending from a floor to a roof at a front side of the operator cabin, the first and second front structural posts are spaced apart laterally on each side of the main frame from the longitudinal axis; and an operator seat mounted in the operator cabin facing forward with respect to the longitudinal axis so as to create a forward field of view to the tool for an operator seated in the operator seat, the operator seat is intersected by a vertical reference axis along which is located an origination point of the forward field of view;

wherein a first reference line passing through the origination point intersects the first front structural post and the first actuator axis, and a second reference line passing through the origination point intersects the second front structural post and the second actuator axis; and wherein, in the forward field of view from a perspective of the origination point, the first front structural post overlaps the first actuator along the first actuator axis and the second front structural post overlaps the second actuator along the second actuator axis.

2. The work vehicle of claim 1, wherein the first and second front structural posts are laterally spaced an equal distance from the longitudinal axis.

3. The work vehicle of claim 1, wherein the operator cabin has a front panel defining a window at the front side of the operator cabin between the first and second front structural posts.

4. The work vehicle of claim 3, wherein the front panel includes an upper window between the first and second front structural posts proximate the roof and a lower window between the first and second front structural posts proximate the floor.

5. The work vehicle of claim 4, wherein the forward field of view through at least one of the upper window and the lower window provides a line of sight for the operator when seated in the operator seat to a pair of steered wheels supported on a front end of the main frame.

6. The work vehicle of claim 1, wherein the first and second front structural posts are straight.

7. The work vehicle of claim 1, wherein the first and second front structural posts are angled such that for each of the first and second structural posts an upper segment follows an upper post axis and a lower segment follows a lower post axis at an angle with respect to the upper post axis;

wherein, in the forward field of view from the perspective of the origination point, the upper and lower segments of the first front structural post overlap the first actuator along the first actuator axis; and wherein, in the forward field of view from the perspective of the origination point, the upper and lower segments of the second front structural post overlap the second actuator along the second actuator axis.

8. The work vehicle of claim 1, wherein the work vehicle is a motor grader and the tool is a blade.

9. The work vehicle of claim 8, wherein the blade is pivotally mounted to a circle to move through a range of pivot angles; and wherein the forward field of view permits a line of sight for the operator when seated in the operator seat to a toe end and a heel end of the blade through the range of pivot angles.

10. A motor grader, comprising:

a main frame extending along a longitudinal axis;

a circle mounted to the main frame below the main frame;

a blade mounted to the circle for pivoting with respect to the main frame;

first and second actuators mounted to the main frame and configured to set a height of respective first and second ends of the blade, wherein, at least when in a home position in which the circle is centered on the longitudinal axis, the first and second actuators are oriented along first and second actuator axes that are spaced apart laterally on each side of the main frame at a distance from the longitudinal axis;

an operator cabin mounted to the main frame behind the blade with respect to the longitudinal axis, the operator cabin having first and second front structural posts extending from a floor to a roof at a front side of the operator cabin, the first and second front structural posts are spaced apart laterally on each side of the main frame from the longitudinal axis; and an operator seat mounted in the operator cabin facing forward with respect to the longitudinal axis so as to create a forward field of view to the blade for an operator seated in the operator seat, the operator seat is interested by a vertical reference axis along which is located an origination point of the forward field of view;

wherein a first reference line passing through the origination point intersects the first front structural post and the first actuator axis, and a second reference line passing through the origination point intersects the second front structural post and the second actuator axis; and wherein, in the forward field of view from a perspective of the origination point, the first front structural post overlaps the first actuator along the first actuator axis and the second front structural post overlaps the second actuator along the second actuator axis.

11. The motor grader of claim 10, wherein the first and second front structural posts are laterally spaced an equal distance from the main frame.

12. The motor grader of claim 11, wherein the operator cabin has a front panel defining a window at the front side of the operator cabin between the first and second front structural posts.

13. The motor grader of claim 12, wherein the operator cabin has windows at laterally outer sides of the first and second front structural posts from the floor to the roof at the front side of the operator cabin including lower window areas adjacent to lateral sides of the main frame.

14. The motor grader of claim 13, wherein the forward field of view provides a line of sight for the operator when seated in the operator seat to a toe end and a heel end of the blade throughout a range of pivot angles in which the blade is pivoted by the circle.

15. The motor grader of claim 10, wherein the first and second front structural posts are straight.

16. The motor grader of claim 10, wherein the first and second front structural posts are angled such that for each of the first and second structural posts an upper segment follows an upper post axis and a lower segment follows a lower post axis at an angle with respect to the upper post axis;

wherein, in the forward field of view from the perspective of the origination point, the upper and lower segments of the first front structural post overlap the first actuator along the first actuator axis; and wherein, in the forward field of view from the perspective of the origination point, the upper and lower segments of the second front structural post overlap the second actuator along the second actuator axis.

17. The motor grader of claim 10, wherein the first and second front structural posts angle laterally outward away from the longitudinal axis from the floor to the roof of the operator cabin.

18. The motor grader of claim 17, wherein the first and second front structural posts angle forward with respect to the longitudinal axis from the floor to the roof of the operator cabin.

19. A motor grader, comprising:

a main frame extending along a longitudinal axis;

a circle mounted to the main frame below the main frame;

a blade mounted to the circle for pivoting with respect to the main frame;

first and second actuators mounted to the main frame and configured to set a height of respective first and second ends of the blade, wherein, at least in a home position in which the circle is centered on the longitudinal axis, the first and second actuators are oriented along first and second actuator axes that are spaced apart laterally on each side of the main frame an equal distance from the longitudinal axis;

an operator cabin mounted to the main frame behind the blade with respect to the longitudinal axis, the operator cabin having first and second front structural posts extending from a floor to a roof at a front side of the operator cabin, the first and second front structural posts are spaced apart laterally on each side of the main frame from the longitudinal axis;

an operator seat mounted in the operator cabin facing forward with respect to the longitudinal axis so as to create a forward field of view to the blade for an operator seated in the operator seat, the operator seat is intersected by a vertical reference axis along which is located an origination point of the forward field of view; and a front panel between the first and second front structural posts at the front side of the operator cabin including a lower window area adjacent to lateral sides of the main frame;

wherein a first reference line passing through the origination point intersects the first front structural post and the first actuator axis, and a second reference line passing through the origination point intersects the second front structural post and the second actuator axis; and wherein, in the forward field of view from a perspective of the origination point, the first front structural post overlaps the first actuator along the first actuator axis and the second front structural post overlaps the second actuator along the second actuator axis.

20. The motor grader of claim 19, wherein the first and second front structural posts are angled such that for each of the first and second structural posts an upper segment follows an upper post axis and a lower segment follows a lower post axis at an angle with respect to the upper post axis;

wherein, in the forward field of view from the perspective of the origination point, the upper and lower segments of the first front structural post overlap the first actuator along the first actuator axis; and wherein, in the forward field of view from the perspective of the origination point, the upper and lower segments of the second front structural post overlap the second actuator along the second actuator axis.

* * * * *